US006099720A

United States Patent [19]

Pontier et al.

[11] Patent Number: 6,099,720

[45] Date of Patent: Aug. 8, 2000

[54] METHOD AND DEVICE FOR DESCENDING CATALYTIC CRACKING BY INJECTING FEEDSTOCK AT AN ADEQUATE ANGLE ON A CONDITIONED CATALYST

[75] Inventors: Renaud Pontier, Vienne; Régis Bonifay, Asniéres; Gérard Courteheuse, Rueil-Malmaison; Mariano Del Pozo, La Havre; Thierry Gauthier, Saint Genis Laval, all of France

[73] Assignee: Institut Francais du Petrole, Rueil-Malmaison, France

[21] Appl. No.: 09/077,007

[22] PCT Filed: Sep. 16, 1997

[86] PCT No.: PCT/FR97/01630

§ 371 Date: Aug. 19, 1998

§ 102(e) Date: Aug. 19, 1998

[87] PCT Pub. No.: WO98/12280

PCT Pub. Date: Mar. 26, 1998

[30] Foreign Application Priority Data

Sep. 18, 1996 [FR] France ..... 96 11379

[51] Int. Cl.[7] ..... C10G 11/14; B01J 8/18

[52] U.S. Cl. ..... 208/113; 208/120.01; 208/153; 422/139; 422/144; 422/145

[58] Field of Search ..... 208/113, 120.01, 208/153; 422/139, 144, 145

[56] References Cited

U.S. PATENT DOCUMENTS

| | | | |
|---|---|---|---|
| 2,668,755 | 2/1954 | Kershaw et al. | 422/139 |
| 4,883,583 | 11/1989 | Mauleon et al. | 208/113 |
| 4,919,898 | 4/1990 | Gartside et al. | 422/219 |
| 5,296,131 | 3/1994 | Raterman | 208/113 |
| 5,324,696 | 6/1994 | Bonifay et al. | 502/43 |
| 5,344,554 | 9/1994 | Pontier et al. | 208/164 |
| 5,449,496 | 9/1995 | Pontier et al. | 422/144 |
| 5,686,049 | 11/1997 | Bonifay et al. | 422/144 |

*Primary Examiner*—Walter D. Griffin
*Assistant Examiner*—Nadine Preisch
*Attorney, Agent, or Firm*—Millen, White, Zeleano & Branigan, P.C.

[57] ABSTRACT

A process is described for catalytic cracking of a petroleum feed in which a catalyst from a regeneration zone 4 is caused to flow in a dense fluidized bed conditioning zone 2 upstream of an injection zone 10, the fluidization rate being 0.1 to 30 cm/s. The throughput of catalyst into injection zone 10 is regulated by a constriction means 11. The hydrocarbon feed 12 is injected below the constriction means and flows counter-current to the direction of flow of the shaped catalyst flow. The hydrocarbon feed 12 is injected at a set injection angle depending on the movement of the feed and the catalyst.

24 Claims, 1 Drawing Sheet

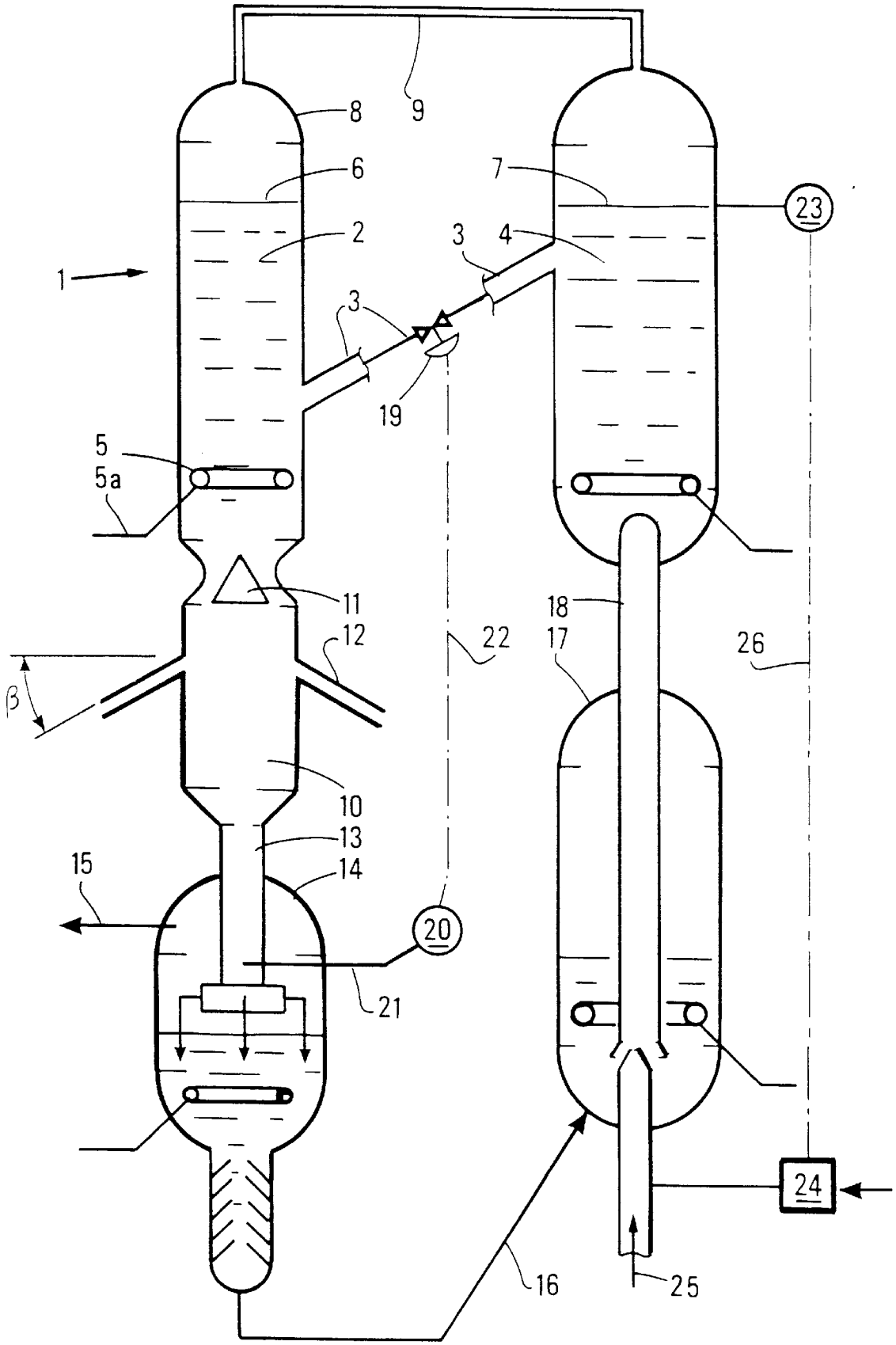
1
2
3
3
4
5
5a
6
7
8
9
10
11
12
13
14
15
16
17
18
19
20
21
22
23
24
25
26
β

METHOD AND DEVICE FOR DESCENDING CATALYTIC CRACKING BY INJECTING FEEDSTOCK AT AN ADEQUATE ANGLE ON A CONDITIONED CATALYST

The invention concerns a fluid catalytic cracking (FCC) process for a hydrocarbon feed in a reaction zone where the feed circulates from top to bottom (dropper).

One of the major problems encountered by the refiner is that of optimizing the production of gasoline along with increased production of light $C_3$ olefins. Technological modifications to riser FCC units consist of reducing the residence time in the catalytic zone to bring such values to less than 0.5 s, essentially by an increase in the rate of circulation of the feed and the catalyst. Combined with an increase in the reaction temperature, such a reduction in the residence time encourages primary cracking reactions to the detriment of consecutive hydrogen transfer and secondary cracking reactions.

In a further technological modification along the same lines, back-mixing, which is a characteristic of riser units, is reduced by using a dropping co-current of gas and catalyst. In this type of flow the radial concentration and flow rate profiles are "flatter", and so approach "piston" flow which is well known to encourage gasoline selectivity and to reduce secondary cracking reactions.

The major problem with this type of reactor concerns the intimate contact between the hot regenerated catalyst and the hydrocarbon feed.

U.S. Pat. No. 4,919,898 describes the formation of a falling curtain of catalyst from rectangular openings provided in a bed pressurized by steam. Such a bed is regulated by the pressure difference between the vessel containing the pressurized bed and a chamber for mixing catalyst and feed downstream of the bed.

That patent also describes injection of the feed in the direction of the valve forming the curtain.

Operating a pressurization system on an industrial scale is difficult because there is a very large variation in flow rate for a very small pressure variation, which can result in an unstable solid flow rate and can thus be deleterious to the selectivity towards the desired products.

U.S. Pat. No. 5,296,131 also describes an annular curtain of downward flowing catalyst. At least part of the feed is injected towards the bottom through a radial opening under the seat of a cone shaped plug valve against the upper part of the reactor.

The prior art is also illustrated by European patent application EP-A-0 209 442 which describes the presence of a valve downstream of a first fluidization ring which disturbs the fluidization conditions to cause defluidization leading to the production of a volumetric mass corresponding to a loos packed bed.

The invention aims to overcome the disadvantages of the prior art.

It has been observed that by conditioning the density of the catalyst, causing it to move in suitable geometric forms and by optimizing the zone for injecting the feed into the reaction zone, the selectivity of the cracking reaction is substantially improved.

More precisely, the invention provides a process for the fluidized bed catalytic cracking of a petroleum feed to lighter effluents in a catalytic cracking zone comprising a reaction zone or dropper, into an upper end of which, termed the injection zone, regenerated catalyst from at least one regeneration zone is introduced, the catalyst is shaped by means of a shaping means having a constriction, the catalyst is brought into contact with the feed, a downward flowing mixture of catalyst and feed is formed, and at least the majority of the feed is vaporized in said injection zone, said feed is cracked to obtain lighter effluents, the effluents are separated from the used catalyst in a separation zone at the lower end of the dropper, the effluents are recovered and the used catalyst is recycled to the regeneration zone, the process being characterized in that the regenerated catalyst from the regeneration zone is caused to flow in a dense fluidized bed catalyst conditioning zone upstream of the injection zone, the conditioning zone comprising a gas disengagement zone, the fluidization rate by a fluidization gas being in the range 0.1 to 30 cm/s, the throughput of catalyst flowing under gravity into the injection zone is regulated, the feed is injected into the injection zone below the catalyst shaping means, in a counter-current to the direction of flow of the catalyst and at a pre-set injection angle which depends on the linear momentum of the feed and the linear momentum of the catalyst and the mixture containing the vaporized feed is caused to flow in the reaction zone or dropper.

The throughput of the catalyst flowing under gravity through the constriction with a variable or constant cross section of flow is generally in the range 200 to 20000 $kg/m^2s$, preferably in the range 1000 to 10000 $kg/m^2s$; an excellent range of values is between 4000 and 6000 $kg/m^2s$.

The feed is advantageously injected by means of a plurality of injectors located all around the wall of the injection zone at an angle of less than or equal to 30 degrees to the horizontal, preferably at an angle of 5 to 25 degrees.

In general, the angle of injection $\beta$ is determined so that the resultant of the vectors standing for the linear momentum of the feed and the linear momentum of the catalyst is substantially horizontal, for example at about ten degrees about the horizontal. More precisely, the ratio of the catalyst to the feed in the injection zone can be in the range 5 to 20 by weight, preferably in the range 10 to 18. The flow rate of the catalyst flowing under gravity through the constriction can be 0.1 to 20 m/s, advantageously 0.5 to 5 m/s, while the flow rate of the atomized feed droplets is normally in the range 50 to 100 m/s, preferably in the range 70 to 90 m/s.

A curtain of catalyst can, for example, be shaped in two different manners:

In a first variation, a means for shaping said curtain can be formed, which comprises a fixed portion attached to the wall of the injection zone and integral therewith and a central movable portion co-operating with the fixed portion to create said constriction with a variable cross section of catalyst flow. The throughput of catalyst in the injection zone for a fixed flow rate can thus be achieved by varying the cross section of flow between said fixed portion and said movable portion of said means for shaping the catalyst. This adjustable mode of regulation is particularly advantageous during start-up of the unit, which is an unsteady state.

In a second variation, the curtain of catalyst can be shaped using a shaping means comprising a fixed central portion co-operating with the wall of the injection zone or with a fixed portion attached to said wall.

The central, fixed or movable, portion, which is advantageously conical or tapered in form, determines, with the normally cylindrical wall, a constriction in the cross section of catalyst flow which is constant or variable depending on the case, preferably annular. Clearly, the central fixed or movable portion can be cylindrical, spherical or ovoid in form. Such catalyst shaping means are described in our French patent (FR-A-2 631

857) which is hereby incorporated by reference, which also describes injection of the feed in a direction perpendicular to the catalyst flow.

In a third variation, the catalyst can pass through a constriction in said shaping means which has a substantially constant but circular cross section of flow.

The flow rate of the catalyst in the injection zone can be adjusted using a variable opening valve which can be that of the first variation or a variable opening valve located in the line for introducing hot regenerated catalyst to the conditioning zone. This valve is also controlled by a temperature sensor at the dropper outlet.

The catalyst conditioning zone can comprise a zone for disengaging gas from the catalyst above the dense fluidized bed at a height which is between a third and half the total height of the conditioning zone. The pressures in the conditioning zone and in the regeneration zone can be equalized by means of a pressure equalization line connecting the upper portion of the disengaging zone to the upper portion of the regeneration zone. Under these conditions, the heights of the dense fluidized beds in the conditioning zone and in the regeneration zone are substantially the same.

Since gas can be readily released from the catalyst in a sufficiently large volume in the disengaging zone, substantially no bubbles of fluidization gas rise in the catalyst supply line from the regenerator and thus the flow of the solids is not disturbed.

The injection chamber in the reaction zone is generally dimensioned to receive a given mass of catalyst such that the residence time in this zone is generally in the range 0.02 s and 0.5 s, preferably in the range 0.03 s to 0.1 s.

The catalyst can be one which is known in the art, for example those cited in U.S. Pat. No. 5,296,131.

The means for introducing the hydrocarbon feed can be any known means for introducing a hydrocarbon feed, preferably in the form of droplets, preferably having an average diameter of less than $5\times10^{-4}$ meters (m), advantageously less than $1\times10^{-4}$ m. Preferably, the hydrocarbon feed is introduced so as to form fine droplets which are homogeneously distributed in the introduction zone. An auxiliary, atomizing, fluid which encourages the production of fine droplets can also be introduced with the hydrocarbon feed. This auxiliary fluid is normally a gas such as steam or a gas which is relatively rich in hydrogen or in hydrogenated compounds from other units in the refinery.

Atomization is generally carried out outside the reaction zone.

The ends of the conventional injectors normally open into the inside of the injection zone. A jet of droplets of feed with a dimension substantially equal to that of the particles and at the angle of injection of the invention break the falling curtain or stream of catalyst.

These injectors are normally located at the periphery of the injection zone below the catalyst shaping means and their extremities are located in at least one plane which is substantially perpendicular to the axis of the injection zone or dropper.

The distance of these injectors, from the theoretical points of impact of jets of feed on the injection zone (or reaction zone) axis, to the lowest point of the catalyst shaping means, is at most twice the diameter of the injection zone.

This distance is preferably 0.5 to 1 time the diameter of the injection zone.

Optimizing this distance and the angle of injection of the counter-current of feed combined with optimization of the throughput of catalyst flowing through the constriction can substantially improve gasoline selectivity.

The invention also provides a catalytic cracking unit with a dropper reactor for catalytically cracking a hydrocarbon feed in the presence of a cracking catalyst to produce an effluent of lighter products and coked cracking catalyst. The unit comprises a means with a constriction for shaping the catalyst upstream of the dropper, a feed supply communicating with an injection chamber at the upper portion of the dropper and bringing the feed into contact with the shaped catalyst, a chamber for separating effluents from coked catalyst in the lower portion of the dropper and at least one chamber for regenerating coked catalyst communicating with the separation chamber and a line for supplying regenerated catalyst connecting the regeneration chamber to the means for shaping the catalyst, said unit being characterized in that it comprises a chamber for conditioning the regenerated catalyst into a dense fluidized bed connected between the regenerator and the means for shaping the catalyst, said chamber comprising fluidization means and having a zone for disengaging catalyst from gas of suitable volume in the upper portion of said chamber, which communicates with the upper portion of the regeneration chamber via a line for equalizing pressure, and in that the feed injection chamber comprises a plurality of injectors connected to the feed supply line and introducing the feed as a counter-current to the catalyst flow, below the catalyst shaping means, towards the axis of said chamber at an angle of 30° or less to the horizontal.

The invention will be better understood from the FIGURE which schematically illustrates the process and apparatus, viewed along a longitudinal axis.

In FIG. 1, an entrained fluidized bed catalytic cracking apparatus 1 of known type essentially comprises a dropper (downflow reactor) 13 with its upper portion supplied with conditioned catalyst to a conditioning chamber 2. This chamber is supplied with catalyst via at least one inclined line 3 from a regeneration zone which in this case contains two fluidized bed regenerators 4 and 17, mounted one above the other.

The upper portion of the dropper is supplied with a feed introduced by injectors 12 which vaporizes in contact with the hot regenerated catalyst (about 780° C.). The effluents are separated from the catalyst in a stripper 14 of known type, evacuated via line 15 and the catalyst, once stripped using steam, for example, and containing coke, is recycled to the first regenerator 17 via a recycle line 16. The partially regenerated catalyst, in the presence of a gas containing oxygen, rises into the second regenerator 4 via a lift 25 and undergoes a second combustion step in the presence of a gas containing oxygen. The presence of cyclones or fluidization means in the separator or regenerators, which are of known type, will not be discussed here, and for simplification are not shown in the FIGURE.

More precisely, the hot regenerated catalyst from the second dense fluidized regeneration zone is introduced under gravity via inclined line 3 into conditioning chamber 2 as a dense fluidized bed upstream of dropper 13.

A fluidization ring 5 supplies a fluidization gas 5*a,* which may be steam, to the lower portion of the catalyst conditioning chamber at a rate of 10 cm/s. the catalyst thus has a density which is in the range 550 to 800 kg/m$^3$, typically 600 kg/m$^3$.

Catalyst conditioning chamber 2 is dimensioned so as to have in its upper portion a zone 8 for disengaging gas from the catalyst, located above the inlet to line 3 and at a height which is between a third and a quarter of the total height of the conditioning chamber. A pressure equalizing line 9 connects the disengagement zone to the upper portion of the second regenerator.

Under these conditions, the level 7 of the fluidized bed in the second regenerator, controlled by a level gauge 23 and controlled by an air flow rate regulator 24 for lifting the catalyst, substantially corresponds to that at 6 for the fluidized bed in the conditioning chamber.

Downstream of conditioning chamber 2, the apparatus comprises an injection chamber 10 with a diameter which is at least equal to that of the dropper, at the inlet to which a throughput regulation valve or a valve for shaping a falling curtain of catalyst allows a throughput of catalyst of about 800 kg/m$^2$s through its annular opening or constriction.

This valve can have a fixed central portion or insert which with the wall of the injection zone determines the pre-set cross section of catalyst flow in combination with a further flow rate regulation valve 19 in the catalyst admission line 3.

In a further variation which is not shown, the curtain shaping valve comprises a movable central portion connected to a rod as described in FR-A-2 631 857. The rod is protected from the catalyst by a sleeve containing a flushing gas. The movable central portion of the valve and its seat determine an annular cross section of flow for a given flow rate of catalyst delivered by regulating valve 19 and thus determines a suitable throughput.

The injection chamber generally has a larger diameter than that of the constriction (the widest diameter of the annular curtain of catalyst formed) so that the ends of the feed injectors do not intercept the curtain of catalyst.

After having been atomized outside the apparatus, the feed is injected by a plurality of injectors 12 located at the periphery in a plane which is substantially perpendicular to the axis of the dropper and in which the jet of droplets of feed is directed towards the axis at an angle of injection of close to 25 degrees beneath valve 11 in a counter-current to the falling curtain of catalyst, so that it breaks it up.

The distance of the injectors, taken as the distance between the theoretical points of impact of the jets of feed with the axis of the injection chamber (or dropper) and the lowest point of the means for shaping the curtain of catalyst, is at most twice the diameter of the injection chamber and preferably in the range 0.5 to 1 time that diameter.

This distance of the injectors from valve 11 prevents erosion of the valve and avoids recirculation zones above the injectors of the catalyst and/or the feed.

The feed which is vaporized in contact with the hot catalyst and the mixture can then flow towards the bottom of the dropper 13 where the cracking reaction is carried out. The dropper can have a diameter which is less than that of the injection chamber.

The cracking effluents are recovered via line 15 after steam stripping and the catalyst is recycled to the first regenerator 17.

The flow rate regulating valve 19 is generally controlled via a line 22 by the temperature 20 given by a sensor 21 located at the lower end of the dropper.

The unit is generally started up by closing variable flux constriction 11 or closing an on-off valve which is not shown in the FIGURE, located below means 11, for example, when the latter has a fixed central portion, and determines a constant cross section of flow for the catalyst.

These operations can fill the catalyst conditioning chamber to a suitable level using flow rate valve 19 and the pressure equalization line 9.

The portion of the catalyst shaping means facing the injected feed can be concave in form and thus determine a confinement zone for vaporization of the feed and improve the selectivity of the cracking reaction.

EXAMPLE

A petroleum feed with a density $d_4^{15}$=0.95 and a 50% distillation temperature $T_{50}$=510° C. was introduced into a dropper catalytic cracker under the following operating conditions which were in accordance with the invention:

Catalyst: type Octa 4 from Grace Davidson;

Grain density: 1280 kg/m$^3$;

Average diameter: 75 micrometers;

Catalyst flow rate: 1 t/h;

Catalyst/feed weight ratio: c/o=17;

Fluidization rate in conditioning zone: 15 cm/s corresponding to a density of 580 kg/m$^3$;

Throughput of catalyst flowing through annular cross section of flow: 980 kg/m$^2$s;

Flow rate of droplets in atomised feed: 70 m/s;

Temperature at outlet from second regenerator equal to temperature of catalyst conditioning zone: 780° C.;

Temperature at dropper outlet: 550° C.

The distance along the axis of the feed injectors with respect to the insert (lowest point) was 0.5 times the diameter of the injection chamber.

The following comparative table shows the influence of the angle of feed injection, the other operating parameters remaining constant:

| Yield in | Co-current injection | counter-current injection | | Crossed current injection |
|---|---|---|---|---|
| weight % | β = −10° | β = 35° | β = 22° | β = 0° |
| LPG + dry gases | 22.5 | 26 | 24 | 23 |
| C5 gasoline → 210° C. | 39.0 | 41 | 41 | 40 |
| LCO 210° C.–380° C. | 18.5 | 17 | 17.6 | 18.5 |
| Slurry 380° C.$^+$ | 12.0 | 8 | 9.6 | 11 |
| Coke | 8 | 8 | 7.8 | 7.5 |

The example shows the advantage of injecting the feed as a counter-current to the catalyst (β=22°) with respect to co-current injection or counter-current injection at an angle of more than 30°, combined with introduction of the catalyst into the injection chamber in the form of a curtain, at a suitable density and throughput.

Thus heavy product conversion is encouraged to the gain of more valuable light cuts (gasoline and LPG) due to better contact of the hot catalyst with the droplets of feed.

What is claimed is:

1. A process for fluidized bed catalytic cracking of a petroleum feed to lighter effluents in a catalytic cracking zone comprising:

introducing regenerated catalyst from at least one regeneration zone (4) into an injection zone (10) in the upper end of a reaction zone (13);

shaping the catalyst by means of a shaping means (11) forming a constriction;

bringing the catalyst into contact with liquid feed within said injection zone (10) and forming a downward flowing mixture of catalyst and feed;

vaporizing at least the majority of the feed in said injection zone (10);

cracking said feed in said reaction zone (13) to obtain lighter effluents;

separating said effluents from the used catalyst in a separation zone (14) at the lower end of said reaction zone (13); and recovering the effluents and recycling the used catalyst to said regeneration zone (4);

wherein regenerated catalyst from said regeneration zone (4) is caused to flow in a dense fluidized bed catalyst conditioning zone (2), in which the fluidization rate by a fluidization gas is 0.1 to 30 cm/s upstream of said injection zone (10), said conditioning zone (2) comprising a gas disengagement zone (8);

wherein the throughput of catalyst flowing under gravity into said injection zone (10) is regulated, and wherein said feed is injected into said injection zone (10) below said catalyst shaping means (11), in a direction which is counter-current to the flow of catalyst, the feed injection angle being determined so that the resultant of the vectors of the linear momentum of the feed and the linear momentum of the catalyst is substantially horizontal.

2. A process according to claim 1, wherein the catalyst to feed (c/o) weight ratio in the injection zone is in the range 5 to 20.

3. A process according to claim 1, wherein the flow rate of the catalyst in the injection zone is 0.1 to 20 m/s, and the flow rate of the feed is 50 to 100 m/s.

4. A process according to claim 1, wherein a curtain of catalyst is formed by means of a means for shaping said curtain, said means for shaping comprising a fixed portion fixed to the wall of the injection zone and integral therewith and a central movable portion co-operating with the fixed portion to create said constriction with a variable cross section for passage of the catalyst.

5. A process according to claim 1, wherein the throughput of the catalyst is regulated for a given flow rate in the injection zone by varying the cross section of flow between a fixed portion and a movable portion of said means for shaping the catalyst.

6. A process according to claim 1, wherein the catalyst is caused to flow under gravity by the means for shaping the catalyst which comprises said constriction having a constant cross section of flow.

7. A process according to claim 1, wherein the throughput of the catalyst flowing through the cross section is in the range 200 to 20000 kg/m$^2$s.

8. A process according to claim 1, wherein the residence time in the feed injection zone is 0.02 s to 0.5 s.

9. A process according to claim 1, wherein the gas disengagement zone (8) for disengaging gas from the catalyst above the dense fluidized bed is at a height which is substantially that of the fluidized bed in the regeneration zone and at a height between a quarter and half the total height of the conditioning zone, and in which the pressures in the conditioning zone and in the regeneration zone are equalized by means of an equalization line (9) connecting the disengaging zone to the upper portion of the regeneration zone.

10. A process according to claim 1, wherein the angle of injection of the feed is less than or equal to 30 degrees, excluding zero degree, to the horizontal.

11. A process according to claim 1, wherein the diameter of the injection zone is greater than or equal to that of the reaction zone.

12. A process according to claim 1, wherein the distance of the feed injectors, from the theoretical points of impact of the jets of feed on the axis of the injection zone to the lowest point of the catalyst shaping means, is at most twice the diameter of the injection zone.

13. A catalytic cracking unit comprising:

a dropper reactor (13) for catalytically cracking a hydrocarbon feed in the presence of a cracking catalyst to produce an effluent of lighter products and coked cracking catalyst, a means (11) forming a constriction for shaping the catalyst upstream of the dropper, a liquid feed supply means in fluid communication with an injection chamber (10) at the upper portion of the dropper reactor for bringing liquid feed into contact with the shaped catalyst, a chamber (14) for separating effluents from coked catalyst in the lower portion of the dropper and at least one chamber (4) for regenerating coked catalyst communication with the separation chamber and a line (3) for supplying regenerated catalyst connecting the regeneration chamber to the means for shaping the catalyst, said unit further comprising a chamber (2) for conditioning regenerated catalyst into a dense fluidized bed connected between the regenerator and the means for shaping the catalyst, the conditioning chamber (2) comprising fluidization means (5) and having a zone (8) for disengaging catalyst from gas in the upper portion of said conditioning chamber, which communicates with the upper portion of the regeneration chamber via a line (9) for equalizing pressure, and said injection chamber (10) comprise a plurality of injectors (12) for introducing liquid feed in a direction counter-current to catalyst flow, below the catalyst shaping means, towards the axis of said injection chamber at an angle of 30° or less to the horizontal.

14. A unit according to claim 13, wherein the catalyst shaping means comprises a fixed portion which is integral with the wall of the injection zone and a central movable portion which co-operates with said fixed portion to create said constriction and to form a curtain of catalyst.

15. A unit according to claim 13, wherein the catalyst shaping means comprises a constriction with a constant cross section of catalyst flow.

16. A unit according to claim 13, wherein the distance of the feed injectors, from the theoretical points of impact of the jets of feed on the axis of the injection zone (or the reaction zone) to the lowest point of the catalyst shaping means, is at most twice the diameter of the injection zone.

17. A process according to claim 2, wherein the catalyst to feed weight ratio is in the range of 10 to 18.

18. A process according to claim 3, wherein the flow rate of the catalyst in the injection zone is 0.5 to 5 m/s and the flow rate of the feed is 70 to 90 m/s.

19. A process according to claim 7, wherein the throughput of the catalyst flowing through the cross section is in the range of 1000 to 10000 kg/m$^2$s.

20. A process according to claim 10, wherein said angle is 5 to 25 degrees.

21. A process for fluidized bed catalytic cracking of a petroleum feed to lighter effluents in a catalytic cracking zone comprising:

introducing regenerated catalyst from at least one regeneration zone (4) into an injection zone (10) in the upper end of a reaction zone (13);

shaping the catalyst by means of a shaping means (11) forming a constriction;

bringing the catalyst into contact with feed within said injection zone (10) and forming a downward flowing mixture of catalyst and feed;

vaporizing at least the majority of the feed in said injection zone (10);

cracking said feed in said reaction zone (13) to obtain lighter effluents;

separating said effluents from the used catalyst in a separation zone (14) at the lower end of said reaction zone (13); and recovering the effluents and recycling the used catalyst to said regeneration zone (4);

wherein regenerated catalyst from said regeneration zone (4) is caused to flow in a dense fluidized bed catalyst conditioning zone (2), in which the fluidization rate by a fluidization gas is 0.1 to 30 cm/s upstream of said injection zone (10), said conditioning zone (2) comprising a gas disengagement zone (8);

wherein the throughput of catalyst flowing under gravity into said injection zone (10) is regulated, and wherein said feed is injected into said injection zone (10) below said catalyst shaping means (11), in a direction which is counter-current to the flow of catalyst, the feed injection angle being determined so that the resultant of the vectors of the linear momentum of the feed and the linear momentum of the catalyst is substantially horizontal wherein said feed is introduced in liquid form by means of a plurality of injectors located around the wall of the injection zone.

22. A process according to claim 21, wherein said feed is introduced as atomized droplets.

23. A process according to claim 22, wherein the flow rate of the feed is 50–100 m/s.

24. A process according to claim 22, wherein said droplets have an average diameter of less than $5\times10^{-4}$ meters.

* * * * *